US012139281B2

(12) United States Patent
Apuzzo, III

(10) Patent No.: US 12,139,281 B2
(45) Date of Patent: Nov. 12, 2024

(54) METHODS OF MANUFACTURE FOR MULTI-INGREDIENT BEVERAGE FILTER CARTRIDGES

(71) Applicant: Javacube, Inc., New Canaan, CT (US)

(72) Inventor: Joseph Apuzzo, III, New Canaan, CT (US)

(73) Assignee: Javacube, Inc., New Canaan, CT (US)

( * ) Notice: Subject to any disclaimer, the term of this patent is extended or adjusted under 35 U.S.C. 154(b) by 164 days.

(21) Appl. No.: 18/070,890

(22) Filed: Nov. 29, 2022

(65) Prior Publication Data

US 2023/0166876 A1 Jun. 1, 2023

Related U.S. Application Data

(60) Provisional application No. 63/284,359, filed on Nov. 30, 2021.

(51) Int. Cl.

| | |
|---|---|
| ***B65B 1/32*** | (2006.01) |
| ***B65B 51/04*** | (2006.01) |
| ***B65D 85/804*** | (2006.01) |

(52) U.S. Cl.

CPC ..... *B65B 1/32* (2013.01); *B65B 51/04* (2013.01); *B65D 85/8061* (2020.05)

(58) Field of Classification Search

CPC ..... B65B 29/022; B65B 57/00; B65B 1/32; B65B 1/46; B65B 51/04; B65B 2230/02; B65B 2220/14; B65D 85/8061; B65D 85/8067

See application file for complete search history.

(56) References Cited

U.S. PATENT DOCUMENTS

| | | | | |
|---|---|---|---|---|
| 9,688,465 | B2 | 6/2017 | Trombetta et al. | |
| 9,764,891 | B1 * | 9/2017 | Aviles | B65D 85/8061 |
| 10,633,521 | B2 | 4/2020 | Apuzzo et al. | |
| 2006/0280841 | A1 * | 12/2006 | Cai | A47J 31/14 426/77 |
| 2014/0342059 | A1 * | 11/2014 | Trombetta | B65D 85/8061 426/115 |
| 2018/0201436 | A1 | 7/2018 | Savage | |
| 2019/0322447 | A1 | 10/2019 | Trombetta et al. | |
| 2021/0253336 | A1 * | 8/2021 | Tottone | B65D 85/8067 |

* cited by examiner

*Primary Examiner* — Thomas M Wittenschlaeger

(57) ABSTRACT

Provided are methods for manufacturing a multi-ingredient beverage filter cartridge comprising the steps of: adding an amount of a first soluble beverage medium to the container having an internal bottom end, sidewall, and an access opening opposite the internal bottom end; leveling at least a portion of a top surface of the added first soluble beverage medium so that such top surface is substantially in the range of 1 mm to 11 mm from the internal bottom end; adhering a filter medium to the sidewall such that the filter medium does not contact the first soluble beverage medium, top surface; adding an amount of a second soluble beverage medium to the container such that the second soluble beverage medium forms a layer on top of the filter medium; and enclosing the container with a sealed lid.

25 Claims, 2 Drawing Sheets

METHODS OF MANUFACTURE FOR MULTI-INGREDIENT BEVERAGE FILTER CARTRIDGES

CROSS-REFERENCE TO RELATED APPLICATION

This application claims priority under 35 U.S.C. § 119(e) to U.S. Provisional Patent Application No. 63/284,359, entitled "Methods of Manufacture for Multi-Ingredient Beverage Filter Cartridges," filed on Nov. 30, 2021 which is hereby incorporated by reference herein in its entirety.

FIELD OF THE INVENTION

The instant invention generally relates to methods of manufacture for multi-ingredient, dual chamber, beverage filter cartridges.

BACKGROUND OF THE INVENTION

Beverage filter cartridges are a well-known delivery vehicle for single serve beverages, including single serve coffee. Beverage filter cartridges offer convenience to consumers by allowing them to brew a single cup of a beverage, such as coffee, in under a minute.

A conventional beverage filter cartridge may comprise a plastic shell, a filter medium, a dose of a single beverage medium and a sealed lid. The beverage medium comprises a soluble beverage, which may be ground coffee beans. A common beverage filter cartridge is a K-Cup® pod. Beverage filter cartridges are typically designed to be brewed in a single serve beverage machine which, under pressure, extracts the flavor from the soluble beverage medium, e.g., soluble portion of ground coffee beans, and dispenses liquid beverage. One manufacture of single serve beverage machines is Keurig®.

Inside of a conventional beverage filter cartridge, during the brewing process, a filter is tasked with retaining the any remaining non-soluble materials within the beverage medium during the pressurized brew so that only liquid beverage is dispensed from the beverage filter cartridge. The filter may be positioned to form a filter cartridge that is sealed to the top inner sidewall of the beverage filter cartridge and whose bottom extends not less than 12 mm from the bottom of the outer shell.

A single serve beverage machine may use two hollow needles to puncture the beverage filter cartridge, one through the lid of the beverage filter cartridge through which hot water is forced in and another through the bottom of the shell of the beverage filter cartridge, which serves as the evacuation canal for the brewed beverage. Liquid may be pass through each of these needles which may remain inserted approximately 5 mm into the beverage filter cartridge until the brewing process is complete.

Due to the limitations of the conventional beverage filter cartridge manufacturing processes, ingredients are filled in the beverage medium chamber, i.e., above the filter. This limits the ingredients that can be combined in a beverage filter cartridge to soluble ingredients that can pass through the fine pores of a coffee filter.

The present invention provides methods of manufacture for multi-ingredient, dual chamber, beverage filter cartridges.

SUMMARY OF THE INVENTION

The present invention is directed to methods for manufacturing a beverage filter cartridge containing multiple ingredients in dual chambers, the method comprising the steps of: (a) obtaining a container having an access opening end and an internal bottom end opposite the access opening end and a sidewall; (b) adding an amount of a first soluble beverage medium to the container such that the first soluble beverage medium forms a layer on top of the internal bottom end; (c) leveling at least a portion of a top surface of the added first soluble beverage medium, wherein said top surface is substantially in the range of 1 mm to 11 mm from the internal bottom end of the container; (d) adhering a filter medium to the sidewall of the container such that the filter medium does not contact the top surface of the layer of the first soluble beverage medium, wherein the filter medium is adhered at a location such the lowest point of the filter medium is substantially in the range of 6 mm to 12 mm from the internal bottom end of the container; (e) adding an amount of a second soluble beverage medium to the container such that the second soluble beverage medium forms a layer on top of the filter medium; and (f) enclosing the container with a sealed lid.

BRIEF DESCRIPTION OF THE DRAWINGS

The drawings described below are for illustrative purposes only and are not intended to limit the scope of the invention.

DETAILED DESCRIPTION OF THE INVENTION

Figure 1:
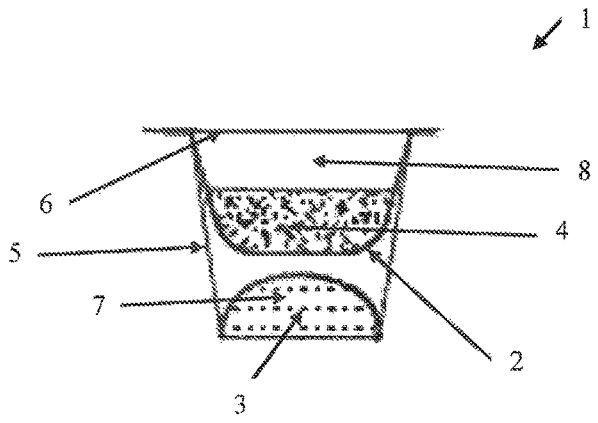
FIG. 1 depicts an exemplary multi-ingredient dual chamber beverage filter cartridge.

It is to be understood that the terminology employed herein is for the purpose of describing particular embodiments, and is not intended to be limiting. Further, although any methods, devices and materials similar or equivalent to those described herein can be used in the practice or testing of the invention, certain methods, devices and materials are now described.

Throughout this application, articles "a" and "an" are used in this disclosure to refer to one or more than one (i.e., to at least one) of the grammatical object of the article.

As used herein, the term "and/or" includes any and all combinations of one or more of the associated listed items. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

The disclosure is further illustrated by the following descriptions, which are not to be construed as limiting this disclosure in scope or spirit to the specific procedures herein described. It is to be understood that the descriptions are provided to illustrate certain embodiments and that no limitation to the scope of the disclosure is intended thereby. It is to be further understood that resort may be had to various other embodiments, modifications, and equivalents thereof which may suggest themselves to those skilled in the art without departing from the spirit of the present disclosure and/or scope of the appended claims.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

It is advantageous to design a manufacturing process that enables the combination of multiple ingredients, some that require filtration and can pass through a filter (coffee, for example) and other ingredients that could not pass through a filter (powdered creamer, for example). As discussed above, the filter present in conventional beverage filter cartridge must be positioned such that the bottom of the filter is not less than 6 mm from the bottom of the outer plastic shell. This is required so that the evacuation needle does not puncture the filter, which would allow non-soluble portions of the beverage medium, e.g., the portions of ground coffee beans not dissolved after contact with a liquid to pass into the resulting beverage. In proper operation, soluble ingredients of the beverage medium and non-soluble portions of the beverage medium having a sufficiently small particle size are able to pass through the filter to be included in the resulting beverage.

Some ingredients within the beverage medium are not dissolved during the brewing process and/or have large particle sizes which would not flow through the filter at desirable rates and thus do not pass into the beverage. Thus, conventional beverage filter cartridge manufacturing techniques do not enable the use of such ingredients.

However, conventional beverage filter cartridge manufacturing techniques result in space for a small sub-filter chamber, i.e., the evacuation chamber that exists between the coffee filter and a closed end of the cartridge housing. The present disclosure discloses manufacturing techniques that utilize this evacuation chamber for additional ingredients which would not dissolve during the brewing process and/or large particle sizes that would not flow through the filter at desirable rates. Additionally, an advantageously large number of different materials are suitable as such additional ingredients including, but not limited to, large particle vitamins, minerals, creamers, sweeteners and flavorings.

Given the wide array of applications, the capability of the manufacturing process to meet the needs of many different ingredients is paramount.

In a machine designed to fill beverage filter cartridges, a pre-formed plastic cartridge shell is dispensed into the machine and placed into a carrier system that transfers the cartridge shell to each station of the machine. While a machine might involve inserting an empty cartridge, applying a filter, dosing ground coffee, check-weighing the filled cartridge and sealing a lid to the cartridge, the present method involves multiple additional steps to improve on existing processes and to make multi-ingredient beverage filter cartridges.

After a shell having an access opening, i.e., open end and a closed end, opposite the access opening is dispensed into a manufacturing machine and positioned in the carrier plate, an initial step of the process may not be the application of the filter into the open end of the shell, but advantageously instead a pre-filter dosing step. During this step, a precise amount of an ingredient (for example, a soluble powder) may be dosed into the shell. Suitable dosing mechanisms include without limitation a volumetric cup filler, a pre-weigh scaling system or auger screw dosing system.

FIG. 1 depicts an exemplary multi-chamber beverage filter cartridge 1 formed in accordance with the methods described herein. Beverage filter cartridge 1 includes a shell 5 with a closed end and an open end. A seal 6 is adhered to the shell 5 at its open end, A filter 2 is disposed internal to the shell 5 and attached to shell 5 between the shell's open and closed ends. A beverage medium chamber 8 is defined internal to the shell 5 between the filter 2 and seal 6, and an evacuation chamber 7 is defined within the shell 5 between the closed end of the shell 5 and the filter 2. Beverage medium ingredients 4 are disposed in the beverage medium chamber 8 and soluble ingredients 3 are disposed in the evacuation chamber 7. The seal 6 may be, for example, a foil seal used with conventional beverage cartridges, such as the K-cup®.

Figure 2:
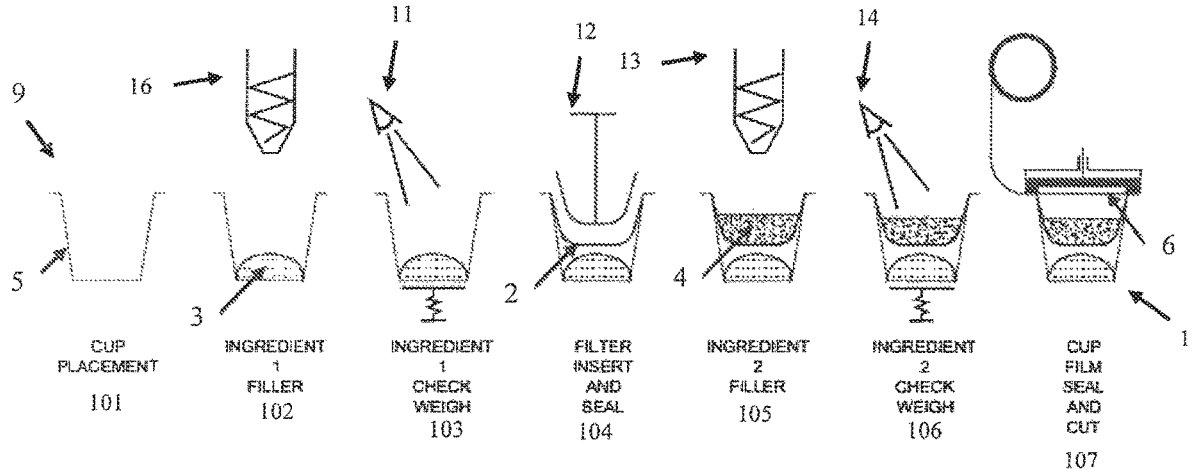
FIG. 2 depicts an exemplary schematic block diagram of a representative stations of beverage cartridge filling system in accordance with this disclosure.
Figure 3:
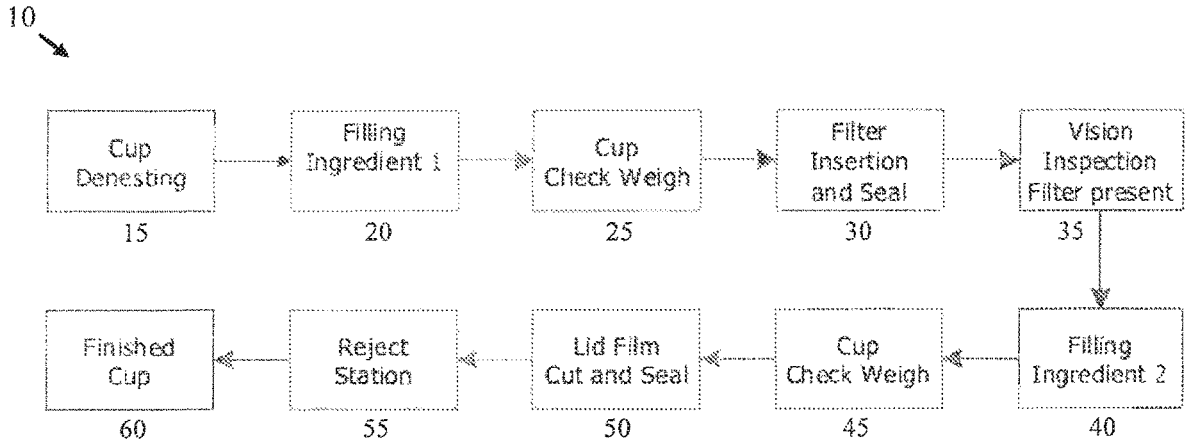
FIG. 3 depicts an exemplary process flow diagram for manufacturing a multi-ingredient, multi-chamber, beverage filter cartridges in accordance with the block diagram of FIG. 2.

FIG. 2 depicts a schematic block diagram and FIG. 3 depicts a flow diagram of an exemplary method 10 and corresponding operation of filling system for manufacturing multi-ingredient filter cartridges in accordance with this disclosure. While FIG. 2 and FIG. 3 will be discussed together, FIG. 2 should not be understood to limit the disclosure of FIG. 3 and vice versa. FIG. 3 generally refers to the steps of the method while FIG. 2 depicts various stages during the manufacturing process of cartridge 1 (in FIG. 1), with each stage performed by one or more different stations of a manufacturing system associated with one or more steps of method 10. However, for ease of explanation, each step depicted in FIG. 3 may be performed by a respective station of such filling system. However, it should be understood that more than one of the depicted steps may be performed by single manufacturing machine stations, and that such manufacturing system may comprising a single manufacturing machine, or in a plurality of manufacturing machines that perform the method 10.

In describing FIG. 2, the shell of the beverage filter cartridge 1 will be referred to as shell 5, see for example, FIG. 1, while the various incomplete stages of the beverage filter cartridge 1 during manufacturing will be referred to as cartridge shell 9. Thus while cartridge shell 9 may refer to shell 5 as in stage 101, cartridge shell 9 may also refer to shell 5 plus the features added to shell 5 as depicted in FIG. 2, such as shell 5 plus soluble ingredients 3 and filter 2 as in stage 104.

Referring to FIG. 2 and FIG. 3, in step 15, a shell 5, or a cartridge shell 9, of FIG. 1, is removed from a nested-stacked nest of cartridge shells, and readied for filling with one or more beverage ingredients at stage 101. Then, in step 20, a first soluble ingredient or soluble ingredients 3 is disposed or "dosed" from dispenser 16 into the cartridge shell 9 at stage 102. In step 25, the quantity of the first ingredient dosed in cartridge shell 9 is verified at stage 103, such as by example, a check-weighing system and optionally with a proximity sensor 11 to determine the height within the cartridge shell 9 of the dosed ingredient(s) to make sure that the dosed amount is Within the intended range for the multi-ingredient filter cartridge.

Verification of the amount of the dosed first ingredient provides enhanced reliability, manufacturability and function of a double chamber beverage filter cartridge. Although the step 25 and stage 103 are represented as a check-weighing, such verification may be alternatively performed in accordance with this disclosure by additional or other means using sensors for detecting other characteristics of the dosed ingredients 3 including, but not limited to, a gravimetric check-weigher, an X-Ray vision system, a camera system and/or a proximity sensor.

Given the space constraints of conventional beverage filter cartridge filling equipment, a sensor with the ability to accurately detect the height of the powder dosed into the cartridge may additionally or alternatively be employed providing a cost-effective solution. For this sensor to provide sufficiently reliable information, the first ingredient 3, which may be a powder, should have a relatively level surface and contact the surrounding sidewall at approximately the same height or range of heights relative to the internal bottom of the cartridge shell 9. Exemplary methods to achieve such level surface of the first surface include the use of a settling device such as a vibration mechanism including mechanical vibration devices or low frequency, standing wave generation devices.

Referring again to FIG. 3, the verification step 25 is particularly advantageous for high-value ingredients and other ingredients for the ingredients 3, whereby an incorrect dosed amount might affect the marketability of the final product including, for example, strong spices or vitamins which excess amounts would be harmful for human consumption. In such cases, verification of a precise dose is important to the overall manufacturing process. An active ingredient like many vitamins, capsaicin or apple cider vinegar powder must be dosed within a precise range based on the quantities presented to the consumer.

Referring again to FIG. 2 and FIG. 3 together, after the verification step 25 is completed at stage 103, the filter is inserted and bonded, i.e., sealed, to the shell in step 30 at stage 104, such as by welding or other adhering or sealing processes, by a filter sealing device 12.

In operation of a completed multi-ingredient filter cartridge 1, i.e., during brewing process in a beverage dispensing machine creates pressure within beverage filter cartridge 1. Accordingly, sufficient bond strength of the filter 2 to the internal sidewall of the cartridge shell 9 is required. The presence of powder, particulates or dust, such as from the ingredients 3, could compromise the strength of the bond and jeopardize the functionality of beverage filter cartridge 1. If the quantity of the first ingredients 3 dosed is incorrectly high or its surface is uneven, it could jeopardize the bonding of the filter 2 in this step 25. As a result, the filled cartridge shell 9 could be tagged as defective at the stage 103 so no downstream processes are performed on the tagged in-process cartridge.

Accordingly, in order to address the required precision of the filter application and bonding process it is advantageous to perform a verification of the dose of the ingredients 3 in the cartridge shell 9. The filter 2 may be inserted down through the open end of the cartridge shell 9 at stage 104 until it is positioned at a desired location relative to either or both of the closed and open ends of the cartridge shell 9, and bonded by welding or other adherence technique to the internal wall surface of the cartridge shell 9. The desired location of the filter 2 may be based on multiple factors including, but not limited to, the specified amount of beverage medium ingredients 4, a desired welding position against the internal wall surface of the shell 5 and at a desired height within the cartridge shell 9 near an edge at its open end.

It should be understood that the final location of the filter 2 within the cartridge shell 9 may require a reasonable level of precision for a multi-ingredient beverage cartridge. Thus, the presence of any amount of the ingredients 3 or other debris material at any point along the circumference bonding location of the internal wall of the cartridge shell 9 may result in a non-uniform bond with regions of gaps and/or weak or insecure bonds that may fail during use of the resulting beverage filter cartridge 1. Accordingly, it is important to verify the height of the ingredients 3 within the cartridge shell 9 at stage 103, prior to the application and bonding of the filter 2 to the cartridge shell 9 at stage 104. Importantly, the fill height of the ingredients 3, should be sufficiently lower than the intended welding or adhering location range within the internal wall of the cartridge shell 9 at stage 104 so that the height of the ingredient 3 does not interfere with the bonding process, resulting in a desired attachment of the filter 2 to the internal sidewall of the shell 9 without gaps or weak bonds that may fail during use of the resulting beverage filter cartridge 1.

As indicated above, it is advantageous to remove any particulates of the ingredients 3 or other material, such as dust, from the internal sidewall of the cartridge shell 9 prior to bonding the filter 2 to the internal sidewall of the cartridge shell 9, at stage 104. Such removal may be achieved with the use of static eliminating elements incorporated into the manufacturing machine to cause any particulates, dust or the like present on the inner sidewall of the cartridge shell 9 during or after the dosing cycle to fall down into the bottom of cartridge shell 9. This will result in a clean surface for the filter 2 to be bonded to internal sidewall of the cartridge shell 9.

In some embodiments of the disclosed manufacturing methods, a blocking dosing head is used that contains an apparatus that covers an upper portion of the internal sidewall of cartridge shell 9 near its open end during the dosing operation. This upper portion of the internal sidewall of cartridge shell 9 may be defined as the inner sidewall in the range of 32 mm to 42 mm from the closed end of the cartridge shell 9.

In other additional embodiments, an inlet of a vacuum system is lowered into the cartridge shell 9 at stage 103 or immediately before stage 104. Such system includes a temporary cover that seals to the inner walls of cartridge shell 9 above the dosed ingredients 3 present in the cartridge shell 9 and any dust present above such cover is vacuumed away.

Referring again to FIGS. 2 and 3, an optional optical inspection step 35 is performed after the filter 2 is bonded to the cartridge shell 9 in stage 104 to confirm that the filter 2 is properly bonded within a desired location range of the internal sidewall of shell 5.

Due to the rise in popularity of healthy beverages, the described methods herein are useful in delivering active ingredients that are to be consumed in micro doses, such as doses that are less than, for example, 1 gram. Due to the single serve nature of a beverage filter cartridge, the intended dose for the active ingredients needs to also be a portion designed for a single dose. Beverage filter cartridge manufacturing machines are typically designed to run at high speeds, such as for example, 50 cycles per minute, wherein each cycle refers to the parallel manufacture of a set of one or more beverage filter cartridges. For example, a manufacturing machine that runs at 50 cycles per minute with four filter cartridges being manufactured in parallel produces 200 manufactured per minute, Precise dosing of low weight material is difficult to achieve at a cost effective level at such high rates of manufacturing using conventional techniques.

The present method may advantageously include optional steps of pre-blending the active micro ingredient(s) with a bulkier material, such as creamer or fiber, to provide advantages in speed and accuracy of such micro doses. For example, in an exemplary embodiments, the mixture for the ingredient 3 consists of 99% non-active fiber ingredients with 1% active ingredients. Suitable non-active and active ingredients for use with this embodiment of the disclosure include without limitation a fiber and a vitamin, respectively. In this example, this would allow for, for example, 3 grams of overall material for the ingredients 3 to be dosed into the closed end of the cartridge shell 9 with only, for example, one percent ON of it or 0.03 grams being a vitamins. Thus, a slight dosing variation of 0.1 grams, for example, will then have a minor or non-material impact of a fraction of one percent of the overall quantity of vitamin delivered. If the dose was solely the active ingredient, a 0.1 gram overage of the ingredients 3 would result in disadvantageous high percentage over the desired quantity.

Referring again to FIG. 2 and FIG. 3, in step 40 the cartridge shell 9 may be moved to stage 105, where the beverage medium 4 is dosed with apparatus 13 over the filter 2 bonded to the cartridge shell 9, Such dosing may be performed by, for example, an auger dosing device. Thereafter, the cartridge shell 9 may be moved in step 45 to a check-weigh station or stage 106, which determines the weight of partially-completed cartridge and optionally to determine the level height of the beverage medium 4 in the cartridge shell 9 by a proximity sensor 14.

Given the verification of the quantity and/or weight of the first ingredient added during the step 20, which will provide the weight of the cartridge shell 9 and the first dosed ingredient 3 and a known average weight of the filter material used per cartridge, the weight of the second ingredient can be calculated based on the total weight measured by the full check-weigher.

Step 45 may alternatively be performed by other known methods including having a machine pick-up cartridge shell 9 containing the ingredients 3 and 4 and filter 2 verifying that its weight is proper and then dropping cartridge shell 9 back a carrier plate. The proper and isolated verification of each dosed ingredient 3 and 4 is important to the functionality of a multi-ingredient, multi-chamber beverage filter cartridge in accordance with this disclosure.

In the methods described herein, a vacuum station may remove any residual dust from the manufacturing machine that is not in a cartridge shell.

Referring again to FIG. 2 and FIG. 3, step 50 includes bonding and cutting steps which may be performed at a sealing and cutting station 107. During step 50, a seal material is applied and sealed to the open end of the cartridge shell 9 and a cutting tool is employed to cut any excess seal material extending beyond the outer circumferential edge of the cartridge shell 9 to form the seal 6 and completed beverage filter cartridge 1. The material for the seal 6 may come on large roll of material. Alternatively, a pre (die) cut seal 6 may be obtained such that the machine is only sealing seal 6 to the open end of the cartridge shell 9 during step 50.

Referring again to FIG. 2 and FIG. 3, optional step 55 includes moving any tagged for rejection cartridge shells 9 to a reject station capable of rejecting cartridges if they do not conform to specific specifications. After optional step 55, step 60 results in a completed and verified beverage filter cartridge 1.

In the methods described herein, completed beverage filter cartridge 1 may be transferred out of the manufacturing machine.

It should be understood that the cartridge shell 9 may be comprised of material(s) including without limitation, plastic, biodegradable plastics, metal and fiber materials, which enable the maintaining of the respective ingredients 3 and 4 and adherence of the filter 2, and the seal 6 to form the beverage cartridge 1. Conventional beverage filter cartridges are produced with standard beverage mediums dosed into a beverage medium chamber. Other conventional beverage filter cartridges are also produced with soluble ingredients dosed into a filter-less cartridges.

In producing a beverage with a beverage filter cartridges, back pressure is desired to force hot water dispensed into the cartridge to come in contact with all of the beverage medium Within the filter (i.e. in the beverage medium chamber). With hot water being inserted through a hole punctured by a hollow needle, this overall disbursement is crucial. As the beverage medium particles become saturated and the pores of the filter begin to slightly clog up, that back pressure increases and more of the particles of the beverage medium ingredients are exposed to the hot water. The presence of the ingredients 3 below the filter 2 in the evacuation chamber 7 will advantageously facilitate such back pressure and most importantly will provide the most amount of back pressure early in the brewing process prior to evacuation. Given the delayed saturation process of the particles of the beverage medium 4, the first segment of the brewing cycle is where additional back pressure is most desired.

In no-filter beverage cartridges, there may typically be up to 15 grams of a soluble material, e.g. cocoa powder and sugar, waiting to be fully dissolved and forced out of the cartridge with water. Depending upon the brewing machine, the physical status of the soluble material and other factors, the water has the potential to tunnel through the soluble material and only remove a small fraction from the cartridge. By beneficially including a filter filled with a beverage medium above the soluble material of the ingredients 3 according to this disclosure, the hot water (or other liquid) is evenly dispersed and falls on top of all of the soluble powder making it much less likely for the water to cavitate and not extract the evacuation chamber 7 ingredient in its entirety.

For the foregoing embodiments, each embodiment disclosed herein is contemplated as being applicable to each of the other disclosed embodiments.

Provided are methods for manufacturing a beverage filter cartridge containing multiple ingredients in dual chambers, the method comprising the steps of: (a) obtaining a container having an access opening end and an internal bottom end opposite the access opening end and a sidewall; (b) adding an amount of a first soluble beverage medium to the container such that the first soluble beverage medium forms a layer on top of the internal bottom end; (c) leveling at least a portion of a top surface of the added first soluble beverage medium, wherein said top surface is substantially in the range of 1 mm to 11 mm from the internal bottom end of the container; (d) adhering a filter medium to the sidewall of the container such that the filter medium does not contact the top surface of the layer of the first soluble beverage medium, wherein the filter medium is adhered at a location such the lowest point of the filter medium is substantially in the range of 6 mm to 12 mm from the internal bottom end of the container; (e) adding an amount of a second soluble beverage medium to the container such that the second soluble beverage medium forms a layer on top of the filter medium; and (f) enclosing the container with a sealed lid.

In one embodiment, the method further comprises a step of determining the amount of added first soluble beverage medium to the container.

In some embodiments, the method further comprises a step of determining the amount of the first soluble beverage medium to be added to the container. In embodiments, the step of determining is performed with a gravimetric checkweigher, an X-ray vision system, a camera system or a proximity sensor or some combination of these systems.

In embodiments, the amount of the first soluble beverage medium is determined by detecting the height of the level of the first soluble beverage medium relative to the internal bottom end of the container. In one embodiments a settling device or a vibration mechanism is used for implementing the leveling step.

In one embodiment, the method further comprises a step of comparing the amount of the first soluble beverage medium to a reference value and if the amount is greater than the reference value, identifying the container as unsuitable to proceed to step d). In another embodiment, the method further comprises a step of comparing the amount of the first soluble beverage medium to a reference value and if the amount is less than or equal to the reference value, identifying the container as suitable to proceed to step d).

In one embodiment, the method further comprises step of subjecting the container to a static eliminator prior to step d).

In some embodiments, the amount of the first soluble beverage medium is added by an apparatus which also covers a portion of the sidewalls of the container proximate the access opening thereby reducing the amount of the first soluble beverage medium contacting the sidewall.

In one embodiment, the method further comprises steps of: (a) temporarily covering and sealing the sidewall of the container at a level at least above 25 mm from the internal bottom surface of the container; and (b) vacuuming any amount of the first soluble beverage medium present above such level.

In some embodiments, the first soluble beverage medium comprises an ingredient of interest and a filler material. In one embodiment, the filler material is a creamer or a fiber.

In embodiments, the ingredient of interest is a vitamin, capsaicin, an apple cider vinegar powder, a mineral, a creamer, a sweetener, a flavoring or combinations thereof. In some embodiments, the amount of the ingredient of interest is equal to or less than equal to or less than 2%, equal to or less than 5%, equal to or less than 10%. 1%, 2%, 5%, or 10%, of the total weight of the soluble beverage medium.

In one embodiment, the second soluble beverage medium is ground coffee.

In embodiments, the method further comprises the step of determining the amount of the second soluble beverage medium in the container by weighing the container and subtracting the mass or weight of the first soluble beverage medium and the mass or weight of the filter medium. In some embodiments, the mass or weight of the filter medium is based on the average mass or weight of a large sample of filter mediums.

In one embodiment, the first soluble beverage medium comprises a vitamin, a mineral, a creamer, a sweetener, a flavoring or combinations thereof. In embodiments, the first soluble beverage medium is a powder and/or is water soluble. In some embodiments, the first soluble beverage medium is not able to pass through the filter medium.

In one embodiment, the step of adhering the filter medium comprises welding the filter medium to the sidewall of the container.

It is to be understood that the invention is not limited to the particular embodiments of the invention described above, as variations of the particular embodiments may be made and still fall within the scope of the appended claims.

The invention claimed is:

1. A method for manufacturing a beverage filter cartridge, the method comprising the steps of:

a. obtaining a container having an access opening and an internal bottom end opposite the access opening and a sidewall;

b. adding an amount of a first soluble beverage medium to the container such that the first soluble beverage medium forms a layer on top of the internal bottom end;

c. leveling at least a portion of a top surface of the added first soluble beverage medium, wherein said top surface is substantially in the range of 1 mm to 11 mm from the internal bottom end of the container;

d. adhering a filter medium to the sidewall of the container such that the filter medium does not contact the top surface of the layer of the first soluble beverage medium, wherein the filter medium is adhered at a location such the lowest point of the filter medium is substantially in the range of 6 mm to 12 mm from the internal, bottom end of the container;

e. adding an amount of a second soluble beverage medium to the container such that the second soluble beverage medium forms a layer on top of the filter medium; and f. enclosing the container with a sealed lid.

2. The method of claim 1, further comprising the step of determining the amount of added first soluble beverage medium to the container.

3. The method of claim 2, wherein the step of determining is performed with a gravimetric checkweigher, an X-ray vision system, a camera system or a proximity sensor.

4. The method of claim 2, wherein the amount of the first soluble beverage medium is determined by detecting the height of the level of the first soluble beverage medium relative to the internal bottom end of the container.

5. The method of claim 2, further comprising the step of determining the amount of the first soluble beverage medium to be added to the container.

6. The method of claim 1, further comprising the step of determining the amount of the first soluble beverage medium to be added to the container.

7. The method of claim 6, wherein the step of determining is performed with a gravimetric checkweigher, an X-ray vision system, a camera system or a proximity sensor.

8. The method of claim 1, wherein a settling device or a vibration mechanism is used for implementing the leveling step.

9. The method of claim 1, further comprising the step of comparing the amount of the first soluble beverage medium to a reference value and if the amount is greater than the reference value, identifying the container as unsuitable to proceed to step d).

10. The method of claim 1, further comprising the step of comparing the amount of the first soluble beverage medium to a reference value and if the amount is less than or equal to the reference value, identifying the container as suitable to proceed to step d).

11. The method of claim 1, further comprising the step of subjecting the container to a static eliminator prior to step d.

12. The method of claim 1, wherein the amount of the first soluble beverage medium is added by an apparatus which covers a portion of the sidewalls of the container proximate the access opening thereby reducing the amount of the first soluble beverage medium contacting the sidewall.

13. The method of claim 1, further comprising the steps of:

a. temporarily covering and sealing the sidewall of the container at a level at least above 25 mm from the internal bottom surface of the container; and b. vacuuming any amount of the first soluble beverage medium present above such level.

14. The method of claim 1, Wherein the first s e beverage medium comprises an ingredient of interest and a filler material.

15. The method of claim 14, wherein the filler material is a creamer or a fiber.

16. The method of claim 14, wherein the ingredient of interest is a vitamin, capsaicin, an apple cider vinegar powder, a mineral, a creamer, a sweetener, a flavoring or combinations thereof.

17. The method of claim 14, Wherein the amount of the ingredient of interest is equal to or less than 1%, equal to or less than 2%, equal to or less than 5%, equal to or less than 10%, 1%, 2%, 5%, or 10%, of a total weight of the soluble beverage medium.

18. The method of claim 1, wherein the second soluble beverage medium is ground coffee.

19. The method of claim 1, further comprising the step of determining the amount of the second soluble beverage medium in the container by weighing the container and subtracting the mass or weight of the first soluble beverage medium and the mass or weight of the filter medium.

20. The method of claim 19, wherein the mass or weight of the filter medium based on the average mass or weight of a large sample of filter mediums.

21. The method of claim 1, wherein the first soluble beverage medium comprises a vitamin, a mineral, a creamer, a sweetener, a flavoring or combinations thereof.

22. The method of claim 1, wherein the first soluble beverage medium is a powder.

23. The method of claim 1, wherein the first soluble beverage medium is water soluble.

24. The method of claim 1, wherein the first soluble beverage medium is not able to pass through the filter medium.

25. The method of claim 1, wherein the step of adhering the filter medium comprises welding the filter medium to the sidewall of the container.

* * * * *